United States Patent [19]

Terrier

[11] Patent Number: 4,532,486

[45] Date of Patent: Jul. 30, 1985

[54] REMOTE CONTROLLED CIRCUIT BREAKER

[75] Inventor: Gérard Terrier, St. Martin D'Heres, France

[73] Assignee: Merlin Gerin, Grenoble Cedex, France

[21] Appl. No.: 546,434

[22] Filed: Oct. 27, 1983

[30] Foreign Application Priority Data

Nov. 3, 1982 [FR] France ..... 82 18551

[51] Int. Cl.[3] ..... H01H 71/10

[52] U.S. Cl. ..... 335/13; 335/22; 335/14

[58] Field of Search ..... 335/13, 14, 17, 18, 335/19, 20, 22

[56] References Cited

U.S. PATENT DOCUMENTS 4,167,716 9/1979 Horn .
4,178,572 12/1979 Gaskill .
4,272,687 6/1981 Borkan .
4,292,612 9/1981 Howell .

FOREIGN PATENT DOCUMENTS 1599040 5/1978 United Kingdom .
2041655 1/1980 United Kingdom .

*Primary Examiner*—E. A. Goldberg
*Assistant Examiner*—George Andrews
*Attorney, Agent, or Firm*—Parkhurst & Oliff

[57] ABSTRACT

A low voltage circuit breaker in a moulded case comprises a breaker unit (10) and a remote control unit coupled to it that controls the swing of a bistable movable contact (22) housed in the breaker unit. A trip mechanism (50) cooperates with movable contact (22) in the case of a fault to swing movable contact (22) into open circuit position independently of the remote control mechanism (48). A resetting handle (88) must be actuated in order to render the circuit breaker reoperative.

9 Claims, 8 Drawing Figures

REMOTE CONTROLLED CIRCUIT BREAKER

The invention concerns a low voltage circuit breaker having a movable contact carried by a tilting contact arm and cooperating in the closed circuit or make position with a stationary contact, the said contact arm being actuated by a spring that moves the contact arm selectively into either of two stable positions, one to close the circuit breaker contacts, the other to open them, exclusive of any other intermediate position, and a heavy duty remote control mechanism having a pivoting rocker arm cooperating with said spring to swing the said movable contact arm sharply from the closed position into the open position and vice-versa following a remote control signal.

Electrical installations, especially consumer distribution systems, frequently comprise remote controlled apparatus of the kind mentioned, in particular remote operated snap switches or contactors enabling a load supply circuit to be switched ON or OFF by manual or automatic remote control. The circuit is protected by a separate apparatus, specifically a circuit breaker that opens automatically on the occurrence of an overload or fault. This invention stems from the fact that these two apparatuses are generally mounted on the same panelboard, so that an association of both remote control and protective functions in one and the same apparatus would lead to considerable savings in manufacturing and installation costs.

One of the features of the apparatus according to the invention is that it comprises in addition an automatic overload and/or fault trip mechanism cooperating with the said movable contact arm to shift this arm into the open circuit or break position when suppressing a fault current and to hold the movable contact arm in break position independently of the position of the remote control mechanism as long as the trip mechanism remains in the tripped position, and a trip mechanism resetting component to authorize remote operated closing of the circuit breaker when the trip mechanism is in the reset position.

The remote control mechanism and the trip mechanism are independent one of the other but both act on the same movable contact, the linkage between the remote control mechanism and the movable contact being designed so as to avoid any obstruction of the action of the trip mechanism. The heavy duty remote control mechanism is capable of carrying out several tens of thousands of operations whereas the trip mechanism has the features of a circuit breaker with respect to the energy and speed required to cut out a short-circuit current.

There are known circuit breakers equipped with an electrical control permitting make and/or break operations controlled from a distance. The electrical control acts directly on the handle or on the mechanism of the circuit breaker which is designed for a limited number of operations, say a few thousand. These remote controlled circuit breakers are usable in some special cases, e.g., centrally grouped controls, but are not suitable for heavy duty remote controlled operations. On the other hand, it is both difficult and expensive to manufacture circuit breakers that are capable of ensuring a great number of operations. The combination, according to the invention, of two independent mechanisms in the same apparatus, retains the advantages of the low energy remote control mechanism and those of the high energy trip mechanism which has to ensure only a limited number of operations.

The movable contact arm and the remote control rocker arm form a snap-action bistable system, the movement of one of the elements entailing that of the other, so that they always occupy the same position. Whatever the contact opening mode, the rocker arm is in the correct position for the next closing control action.

After tripping on a fault, the trip mechanism must be reset by actuating a resetting handle, to authorize a remote controlled closing operation. The handle automatically takes up open circuit position when the contacts are separated on tripping, but it cannot take up this position unless the contacts are effectively separated. The position of the handle in open circuit position is a visible and reliable indication that the contacts are open.

In one embodiment of the invention the apparatus comprises an electromagnetic trip mechanism with an extractor that acts on the movable contact to shift it rapidly into the break position when tripping on a fault. Tripping on overload is ensured by a bimetal in the usual way, with the arc blown into a quench chamber associated with the contacts.

All the component parts are housed in a moulded case, for instance, belonging to the modular system known by the trade name MULTI 9, the pole pitch being 18 mm. Naturally the apparatus may comprise several poles side by side. The remote control actuator proper is housed in an independent moulded case of the same model, fastened firmly to the circuit breaker unit to form a rigid one piece assembly. This remote control mechanism is conveniently of the type familiar in remote operated snap switches, that causes a change in position on each control pulse. It may be of a different type, for instance with two electro-magnets, one for closing, the other for opening, or with a single electromagnet in conjunction with a drawback spring. The remote control unit is equipped with an emergency operating lever which replaces the remote control mechanism for manual opening or closing of the apparatus. When work is required on the load circuit it is an advantage to override the remote control to avoid any undesired closing, and for this purpose the resetting handle is designed to permit a manual opening operation of the contacts similar to a tripping operation on a fault that renders the remote control mechanism inoperative. This handle ensures dependable disconnection and to prevent unwarranted handling it is shaped so that a tool is needed to actuate it.

It will be obvious that the applications of this novel switchgear are numerous, from the simple remote operation of a lighting circuit to the automatic control of electric machines through programmable controllers. Its model and pole pitch comply with the requirements of a modular system into which it can be conveniently incorporated.

Other advantages and features will be readily apparent from the following description of one embodiment of the invention, given as an illustrative and not limitative example, and shown on the attached drawings, in which:

FIGS. 1*a* and *b* are schematic elevation and side views of one pole of a circuit breaker according to the invention, shown in the closed circuit position;

Figure 1B:
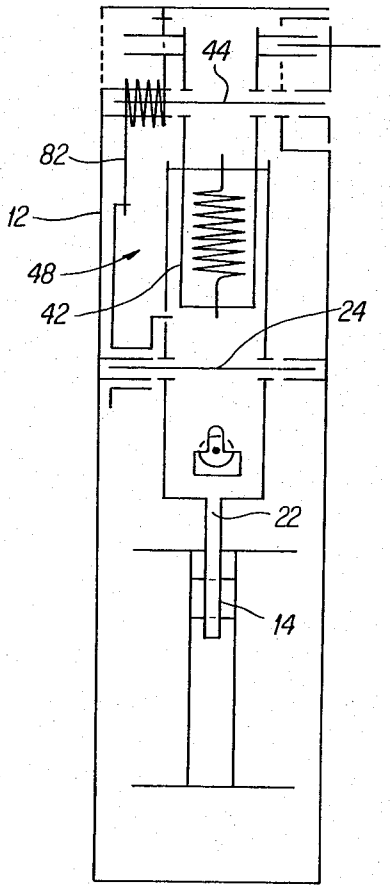

On the figures, a circuit breaker, having the general reference 10, comprises a moulded case 12 with a profile corresponding to the modular system known by the trade name MULTI 9. Several single pole units 10 can be asemmbled or placed side by side to constitute a multipole apparatus with either each unit in its own case 12 or all the units grouped in a single multipole case. Only one of the poles of the circuit breaker is described in detail hereafter, all the others being identical in all respects. Case 12 contains a stationary contact 14 connected by a conductor 16 to a current input terminal 18, as well as a movable contact 20 carried by a contact arm 22, swivel mounted on a stationary pivot 24 fixed in Case 12. Movable contact 20 is electrically linked by braid 26 to the to the input of a tripping coil 28 that has its output linked by braid 30 to bimetal 32 that is connected to the opposite terminal 34. When contacts 14, 20, are in closed circuit position, as shown on FIG. 1, the current input at a given time via terminal 18 flows through closed contacts 14, 20, coil 28 and bimetal 32 before it is output via the opposite terminal 34. When contacts 20, 14, are open, as shown on FIG. 2, the circuit is broken. The movable contact arm 22 extends beyond pivot 24 and at its far end 36 from contact 20, a tension spring 38 is fastened that has its opposite end 40 fastened to a lever or rocker arm 42 mounted to rotate on a stationary pin 44 fixed in case 12. When contacts 14, 20, are in the closed position, shown on FIG. 1, spring 38 exerts a force on contact arm 22 that tends to make arm 22 pivot in an anticlockwise direction, pressing movable contact 20 against stationary contact 14. When lever 42 is pivoted in an anticlockwise direction, shown by arrow 0 on FIG. 1, by a drive mechanism that will be described hereafter, the line of action of spring 38 is shifted beyond a neutral point corresponding to the alignment of points 36, 40, 24, to reverse the direction of the moment acting upon contact arm 22 which moves sharply into the circuit open position illustrated on FIG. 2. The opening movement of movable contact arm 20 is limited by a fixed stop 46. When lever 42 is pivoted in the opposite direction indicated by arrow I, beyond neutral point, contact arm 22 is tilted to bring contacts 14, 20, into the circuit closed position. The combination of contact arm 22, spring 38 and swivel lever 42 forms a bistable mechanism by which the opening and closing of contacts 14, 20, can be remote operated, called hereinafter remote control mechanism 43.

Case 12 houses a trip mechanism 50 comprising an electromagnetic trip control with coil 28 and a thermal bimetal trip control 32. A plunger 52 slides inside coil 28 and cooperates in the attracted position with hammer 54 that pivots trip-rod 56. Plunger 52 carries an extractor 58 the head 60 of which strikes contact arm 22 and pulls it into open circuit position when plunger 52 is attracted. Bimetal 32 cooperates with trip-rod 56 in the case of overload (see FIG. 3) by pivoting it in the clockwise direction so that a catch 62 is released from a hook 64 that rotates on stationary pivot 66 fixed in case 12. Hook lever 64 is elbow-shaped and at its far end carries a slide 68 into which a finger 70 fixed to lever 72 of a toggle 74 is engaged. Finger 70 also is engaged in a slide 76 carried by one of the arms of a lever or swivel part 78 mounted to rotate freely on pivot 24 coaxially to contact arm 22. Part 78 has two other arms, one of which carries on its end a thrust 80 driving contact arm 22, while the other arm cooperates at its end 82 with a coiled trip spring 84. The second lever 86 of toggle 74 is part of a resetting handle 88 mounted to rotate on stationary pivot 90. A drawback spring 92 exerts an anticlockwise force on handle 88, the travel of handle 88 being limited by stops represented by the extreme ends of the opening into case 12 made for handle 88. When handle 88 is in the reset position, as illustrated on FIGS. 1 and 2, spring 84 tends to pivot part 78 in clockwise rotation, but this rotation is prevented by toggle 74 which is in a position beyond neutral, precluding any upward movement (on the figure) of finger 70, driven by slide 76. In this position thrust 80 is separated from contact arm 22 by a clearance "j", preventing any action on contact arm 22 while contacts 14, 20, are in closed circuit position. When trip-rod 56 is pivoted due to the action of a deflection of bimetal 32 in the case of an overload, or to the action of plunger 52 in the case of a short-circuit, hook 64 is released and the kinematic link constituted by slides 68, 76 and finger 70 is broken. This break frees slide 76 and swivel part 78 is driven in clockwise rotation by spring 84, which via thrust 80 drives contact arm 22 towards the open circuit position. The break in link 68, 70, 76 also allows finger 70 to move and toggle 74 to fold in due to the action of drawback spring 92, which moves handle 88 into the open circuit position.

Figure 2:
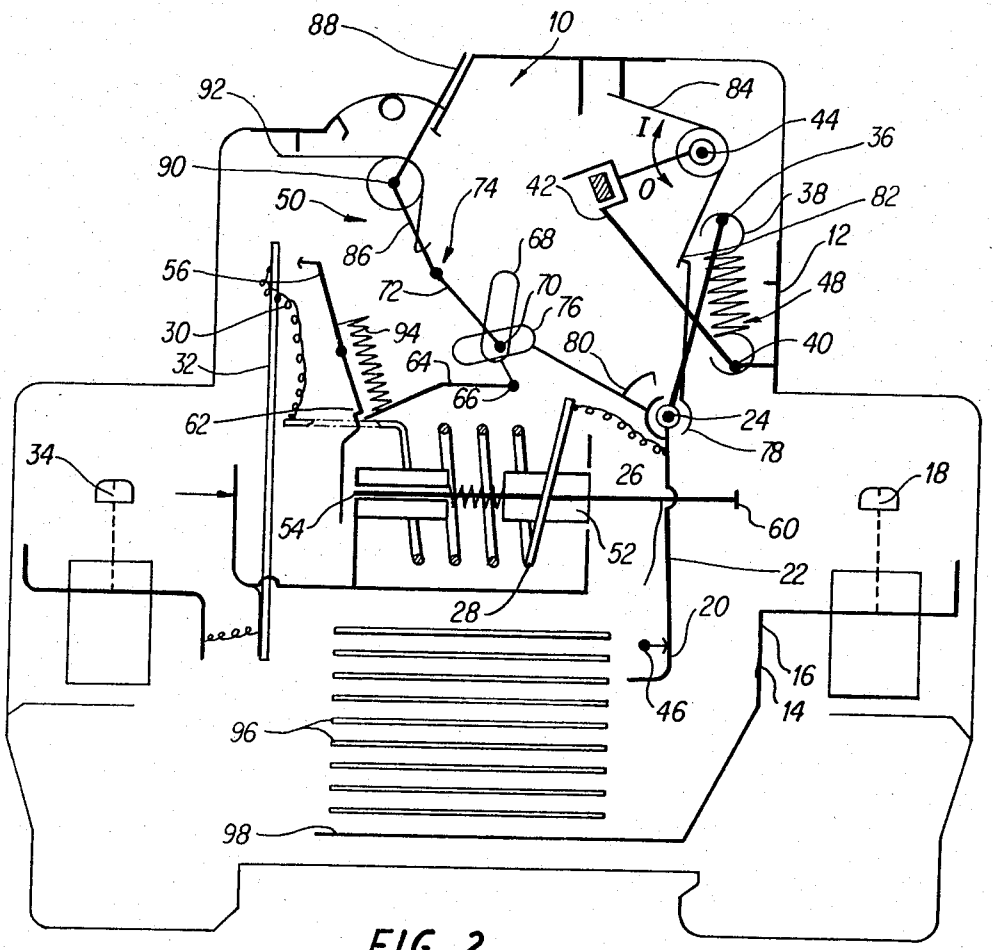
FIGS. 2, 3 and 4 are views similar to that in FIG. 1*a* showing the pole in the position circuit opened by the remote control unit, during tripping, and in the tripped position, respectively.
Figure 3:
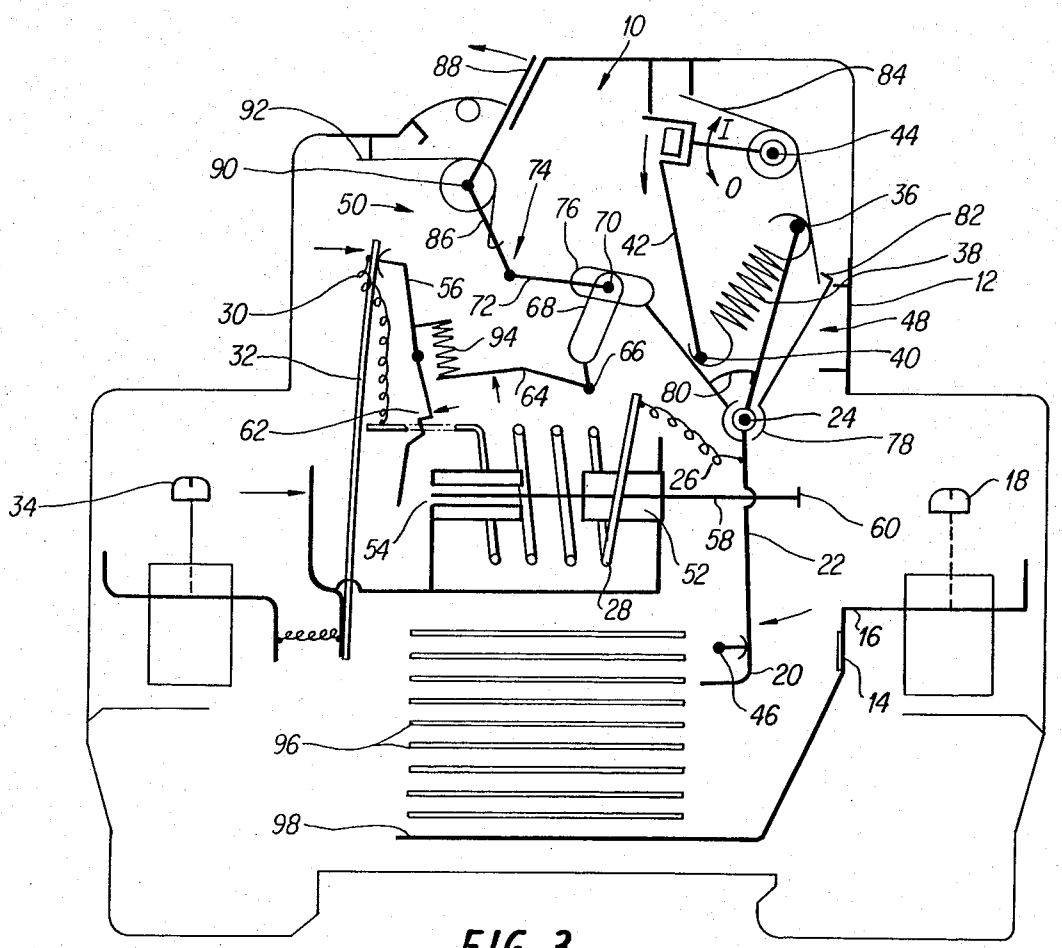
Figure 4:
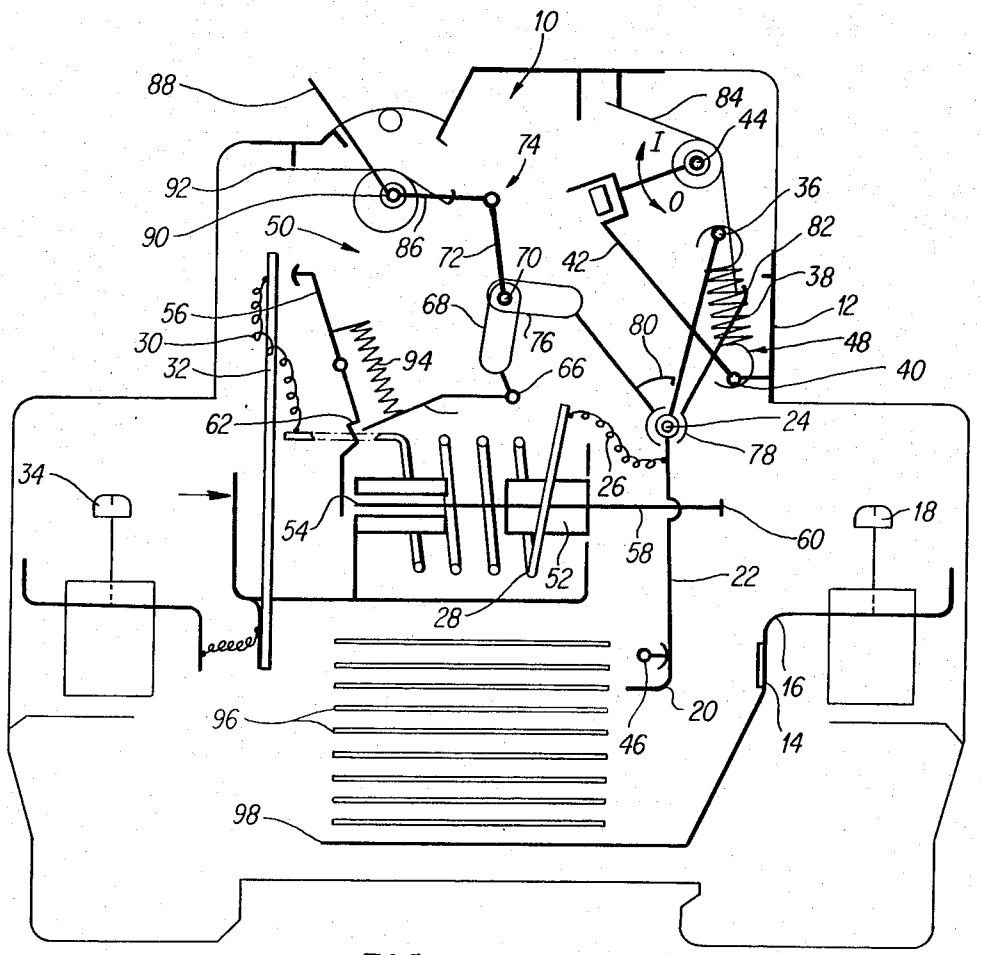
Figure 5:
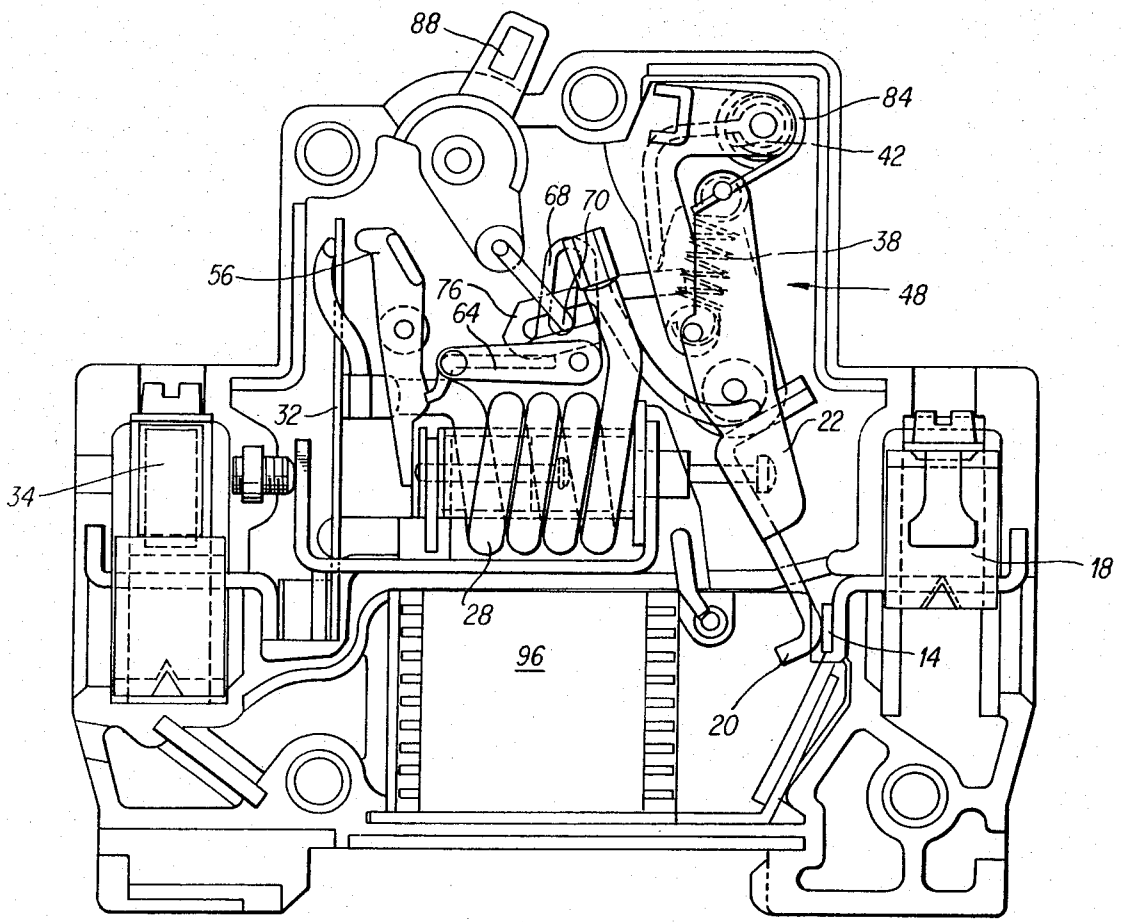
FIG. 5 is an elevation view of one embodiment of the pole illustrated in FIG. 1.
Figure 7:
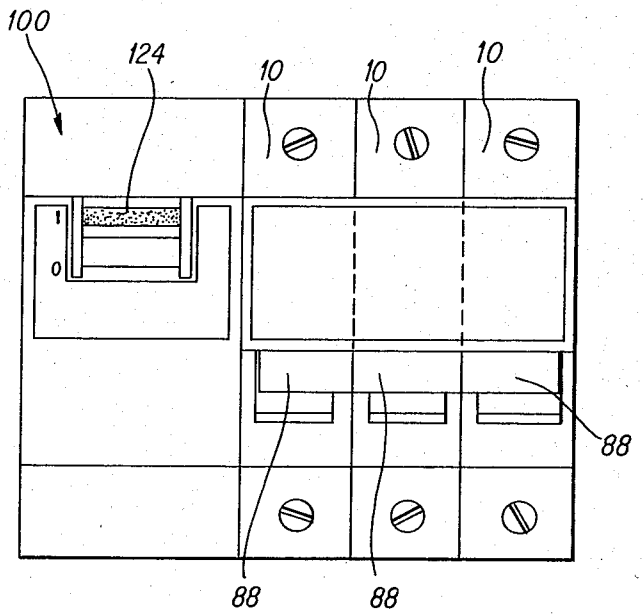
FIG. 7 is a front view of breaker and control units assembled side by side.

FIGS. 3 and 4 illustrate this tripping phase and the final open circuit position after tripping, where hook 64 has returned to the latched position due to the action of drawback spring 94. The swivel of contact arm 22 driven by spring 84, which exerts a much greater force than spring 38, entails a shift in fastening point 36, and, beyond the neutral point corresponding to an alignment of points 44, 36, 40, moves swivel lever 42 into the open circuit position illustrated on FIGS. 2 and 4. When contacts 14, 20, are in open position after tripping, as shown in FIG. 4, spring 84, by means of swivel part 78, holds contact arm 22 in the open position independently of remote control mechanism 48. A remote control signal to close causing swivel lever 42 to pivot clockwise has no effect on contact arm 22 that is locked by the much greater force exerted by spring 84. As soon as the closing control signal terminates, swivel lever 42 is drawn back to its initial open circuit position by spring 38.

Resetting of trip mechanism 50 is carried out by pivoting handle 88 clockwise, causing toggle 74 to extend beyond neutral point, forcing finger 70 to slide in slide 68 and push slide 76 downwards. This movement of slide 76 entails an anticlockwise rotation of swivel part 78, opposing the force of spring 84, towards the initial position of thrust 80.

Contacts 14, 20, are arranged alongside the entrance of a quench chamber with deionizing plates 96. An arc guide 98 connected to stationary contact 14, leads the arc drawn between separated contacts 14, 20, to quench chamber 96 according to normal practice in circuit breakers.

Figure 6:
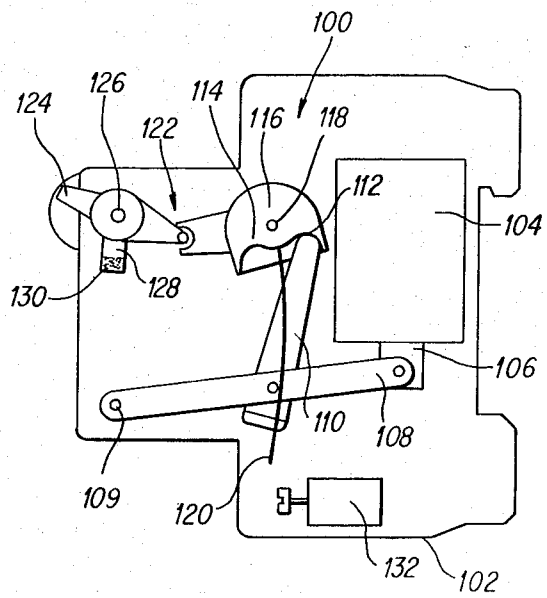
FIG. 6 is a schematic view of the control unit according to the invention.

Next to circuit breaker unit 10 is mounted a remote control unit 100 that has a moulded case 102 with the same profile (FIG. 6). Case 102 houses an electro-magnet 104 with a plunger 106 that actuates a swivel lever 108 hinged at its end on a fixed point 109 in case 102. Lever 108 carries a push-rod 110 the end of which cooperates selectively with shoulders 112, 114 of a rocker 116, mounted to rotate on a stationary pin 118. During this movement, pusher-rod 110 pivots slightly opposing a drawback force exerted by spring 120. When electro-magnet 104 is deenergized, lever 108 and push-rod 110 are brought back to their original position, ready for the next operation when electro-magnet 104 is again energized. During this next operation, push-rod 110 cooperates with shoulder 114, to pivot rocker 116 in the opposite direction. This mode of operation is current practice in remote operated snap switches and will not be further described here. The movement of rocker 116 is transmitted by linkage 122 to a swivel handle 124 mounted to rotate on a stationary pin 126. Swivel handle 124 carries an arm 128 which at one end has a finger 130 leading through the adjoining walls of cases 12, 102, to pin into the swivel lever of rocker arm 42 in circuit breaker unit 10, so as to join mechanically rocker arm 42 and rocker 116. When cases 12, 102 are assembled side by side, pins 44, 126 are practically in line. Moulded case 102 has connection terminals 132 for the wires operating electromagnet 104 by remote control.

Figure 1A:
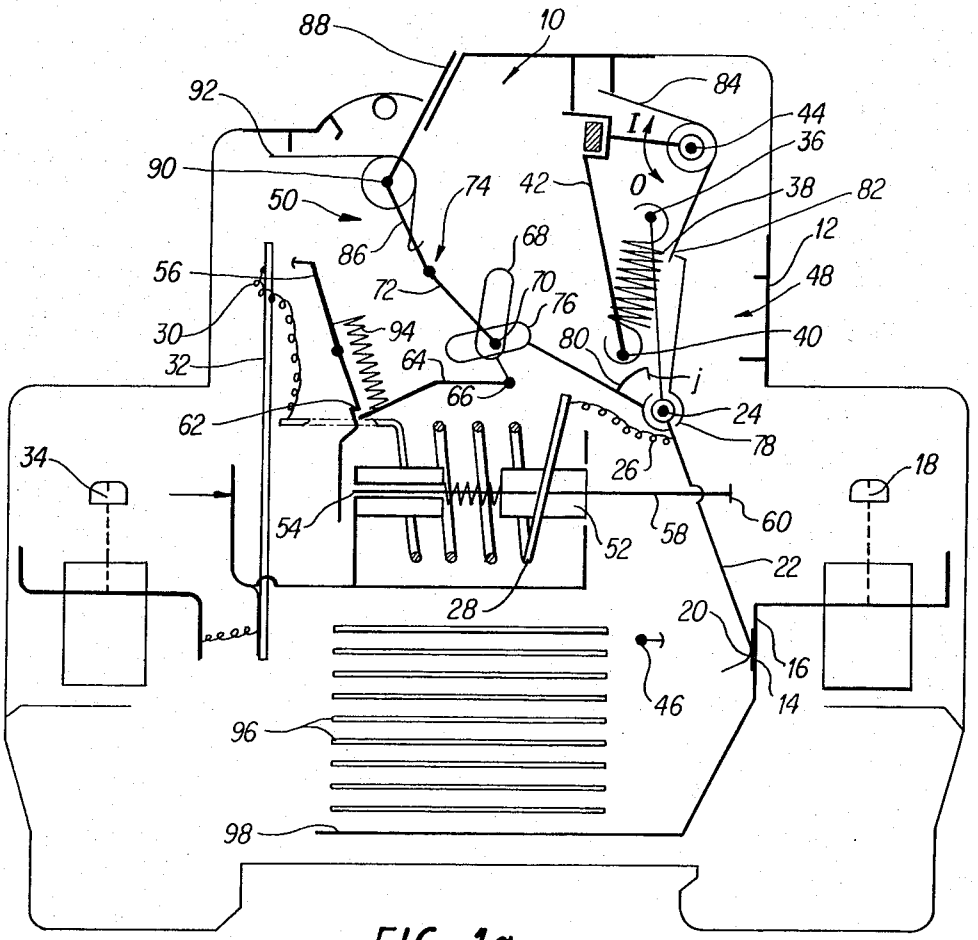

The circuit breaker according to the invention operates in the following manner:

In the position circuit breaker reset, shown on FIGS. 1 and 2, contacts 14, 20, can be opened and closed by remote control by energizing electro-magnet 104 in remote control unit 100. On the first control signal, rocker 116 is tilted anticlockwise as shown on FIG. 6, entailing a corresponding movement of swivel lever or rocker arm 42 towards the closed circuit position shown on FIG. 1. As soon as the neutral point, where points 36, 40, 24 are aligned, is crossed, movable contact arm 22 pivots towards the circuit closed position. When electro-magnet 104 is de-energized, lever 108 and push-rod 110 return to their original position, while rocker 116 and rocker arm 42 remain in the stable circuit closed position. The next control signal energizing electro-magnet 104 causes rocker 116, and rocker arm 42 to pivot in the opposite direction, bringing movable contact arm 22 into the open circuit position once the neutral point, corresponding to alignment of points 36, 40, 24, is crossed. Trip mechanism 50 is not involved by these remote controlled operations and movable contact arm 22 swings freely under the effect of spring 38. Such a mechanism requiring low driving energy can easily carry out a large number of operations. Handle 124 constitutes an emergency operating means for manual opening and closing of contacts 14, 20.

When an overload occurs, with the circuit breaker in the closed circuit position, bimetal 32 is deflected to the right on FIG. 3 and causes trip-rod 56 to pivot in the direction that releases hook 64. Hook 64 is also released when a short-circuit is detected by coil 28 which attracts plunger 52 and causes push-rod 54 to push trip-rod 56 in the direction that releases hook 64. Once the hook is released, the link between toggle 74 and slide 76 is broken and swivel part 78 is rotated clockwise by spring 84, while thrust 80 pushes movable contact arm 22 into the open circuit position. The considerable driving force of spring 84 allows a high-speed displacement of movable contact arm 22, assisted in the case of a short-circuit by the action of extractor 58 fixed to plunger 52. Spring 84 holds movable contact arm 22 in the open circuit position independently of any remote control signal, since spring 38 cannot overcome the force of spring 84. In the tripped open position, shown on FIG. 4, handle 88 has taken up the open circuit position, whereas hook 64 is once again latched. The circuit breaker will not be reoperative until handle 88 is swung into the reset position by a manual resetting action. This swinging movement extends toggle 74, and finger 70 guided by slide 68 pushes slide 76 against the force of spring 84 to give the initial separation position of movable contact arm 22. Handle 88 and toggle 74 are held in the reset position by the force exerted on finger 70 by slide 76, so that toggle 74 remains in a position beyond neutral point. After resetting, the circuit breaker is ready for further operations remote controlled by mechanism 48 as described above.

The arc drawn between contacts 14, 20, on tripping due to overload or short-circuit, is blown towards the deionizing plate chamber 96 where it is rapidly quenched. It should be noted that once contacts 14, 20, are opened on tripping, swivel lever 42 automatically takes up the corresponding open position, authorizing a remote control signal to close the contacts by energizing electro-magnet 104.

To work on the circuit, it can be disconnected by moving handle 88, by means of a tool for instance, from the reset position into the open circuit position. This swinging movement causes toggle 74 to fold in and thrust 80 to pivot due to the action of spring 84. If contacts 14, 20, are closed, they are automatically brought into the open circuit position due to the action of thrust 80. If contacts 14, 20, are already in open circuit position, thrust 80 holds contact arm 22 in open circuit position, thereby preventing contacts 14, 20, from closing, in particular through remote control mechanism 48. The fact that handle 88 is in the open circuit position is a reliable indication that contacts 14, 20, are open. Indeed, should contacts 14, 20, stick due to a shortcircuit current causing mechanism 50 to trip, slide 76 will be held in position by thrust 80, pressing against contact arm 22, and will prevent handle 88 from moving into the open circuit position.

The complete system is particularly simple and the fact that remote control mechanism 48 and trip mechanism 50 operate independently of each other means that each can be adapted specifically to its respective function of remote control and protection. The whole system can be housed in a standard model case for circuit breaker or miniature switchgear so that it can readily be incorporated in a distribution cubicle or distribution switchboard.

The control unit can obviously be constucted in a different way, for instance with two electro-magnets, one to open, the other to close, the circuit, or with any other operating mechanism of swivel lever 42.

The invention naturally covers any alternative embodiment, in particular one in which the control unit is built into the circuit breaker unit, or again, one excluding any manual operation.

I claim:

1. A low voltage circuit breaker comprising:

a movable contact;

a tilting contact arm carrying said movable contact;

a stationary contact engageable in a closed circuit position with said movable contact;

a toggle spring movable between two positions for moving said contact arm alternately into either of two stable positions, one to close the contacts, the other to open them;

a heavy duty remote control mechanism having a pivoting rocker arm for moving said toggle spring between its two positions, thereby to move said contact arm from the closed circuit position to the open circuit position, and vice-versa, responsive to a remote control signal;

an automatic overload/fault trip mechanism movable between a latched reset position and a tripped position, said trip mechanism being connected to said contact arm to move the contact arm to the open circuit position upon the occurrence of a predetermined overload/fault condition, said trip mechanism including:

a trip spring having a higher spring constant than said toggle spring for moving the movable contact arm to the open position and for holding it there regardless of the position of the toggle spring whenever the trip mechanism is in the tripped position; and a trip mechanism manual resetting component for resetting said trip mechanism to the latched reset position after a tripping again to allow remotely controlled operation of the circuit breaker by changing of the position of the toggle spring.

2. A circuit breaker according to claim 1, wherein a first end of the toggle spring is connected to the contact arm, a second end of the toggle spring is connected to the rocker arm and the rocker arm has two positions such that when the rocker arm is in a first of the positions the toggle spring biases the contact arm towards the closed circuit position and when the rocker arm is in a second of the positions the toggle spring biases the contact arm towards the open circuit position, the toggle spring passing through a neutral point when the rocker arm moves from one position to the other.

3. A circuit breaker according to claim 2, wherein the trip mechanism manual resetting component comprises a pivoting handle having a reset position and an open position, said handle being moved into the open position by action of said trip spring when the contacts are opened by the trip mechanism, but remaining in the reset position if the contacts stick together.

4. A circuit breaker according to claim 1, further comprising a breaker unit having a moulded case and a remote control unit having a moulded case that can be adjoined to the moulded case of the breaker unit, said pivoting rocker arm being housed in the breaker unit and coupled to a remote controlled electromagnetic actuator housed in the remote control unit.

5. A circuit breaker according to claim 4, wherein said actuator comprises a bistable rocker and an electromagnet for changing the state of said rocker each time said electromagnet is energized.

6. A circuit breaker according to claim 5, wherein said remote control mechanism further comprises an emergency operation manual component for mechanically moving said bistable rocker to open or close said circuit breaker.

7. A low voltage circuit breaker comprising:

a movable contact;

a tilting contact arm carrying said movable contact;

a stationary contact engageable in a closed circuit position with said movable contact;

a toggle spring movable between two positions for moving said contact arm alternately into either of two stable positions, one to close the contacts, the other to open them;

a quench chamber adjacent to the contacts for quenching any arcs drawn between the contacts;

a heavy-duty remote control mechanism having a pivoting rocker arm for moving said toggle spring between its two positions, thereby to move said contact arm from the closed circuit position to the open circuit position, and vice-versa, responsive to a remote control signal;

an automatic overload/fault trip mechanism movable between a latched reset position and a tripped position, said trip mechanism being connected to said contact arm to move the arm to the open circuit position upon the occurrence of a predetermined overload/fault condition, said trip mechanism including:

a trip spring having a higher spring constant than said toggle spring for moving the movable contact arm to the open position and for holding it there regardless of the position of the toggle spring whenever the trip mechanism is in the tripped position;

an electromagnetic trip control for tripping on a predetermined fault condition and having an extractor for moving said contact arm at high speed into the open position upon such a tripping; and a trip mechanism manual resetting component for resetting said trip mechanism to the latched reset position after a tripping again to allow remotely controlled operation of the circuit breaker by changing of the position of the toggle spring.

8. A low voltage circuit breaker comprising:

a movable contact;

a tilting contact arm carrying said movable contact;

a stationary contact engageable in a closed circuit position with said movable contact;

a toggle spring movable between two positions for moving said contact arm alternately into either of two stable positions, one to close the contacts, the other to open them;

a heavy-duty remote control mechanism having a pivoting rocker arm for moving said toggle spring between its two positions, thereby to move said contact arm from the closed circuit position to the open circuit position, and vice-versa, responsive to a remote control signal;

an automatic overload/fault trip mechanism movable between a latched reset position and a tripped position, said trip mechanism being connected to said contact arm to move the contact arm to the open circuit position upon the occurrence of a predetermined overload/fault condition, said trip mechanism including:

a swivel lever biased by a trip spring having a higher spring constant than said toggle spring for moving the movable contact arm to the open position and for holding it there regardless of the position of the toggle spring whenever the trip mechanism is in the tripped position;

a trip mechanism manual resetting component for resetting said trip mechanism to the latched reset position after a tripping again to allow remotely controlled operation of the circuit breaker by changing of the position of the toggle spring; and a kinematic link between the manual resetting component, the swivel lever and a catch for breaking the kinematic link when the catch is in a tripped position.

9. A circuit breaker according to claim 8, wherein said kinematic link comprises a toggle one end of which is hinged on said manual resetting component and another end of which engages both a first slide carried by said swivel lever and a second slide carried by a lever carrying said catch.

* * * * *